US008533907B2

(12) United States Patent
Eccardt et al.

(10) Patent No.: US 8,533,907 B2
(45) Date of Patent: Sep. 17, 2013

(54) FLEXIBLE CREVICE TOOL ATTACHMENT FOR VACUUM APPLIANCES

(75) Inventors: Curtis J. Eccardt, Defiance, MO (US); Matthew A. Williams, Bridgeton, MO (US); Robert R. Hollis, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 958 days.

(21) Appl. No.: 12/349,507

(22) Filed: Jan. 6, 2009

(65) Prior Publication Data

US 2010/0170060 A1 Jul. 8, 2010

(51) Int. Cl.
*A47L 9/02* (2006.01)

(52) U.S. Cl.
USPC ..... 15/415.1; 138/122; 15/414

(58) Field of Classification Search
USPC ..... 15/415.1, 315; 138/121, 122, 125, 138/126, 129, 130, 177, 178, DIG. 8
See application file for complete search history.

(56) References Cited

U.S. PATENT DOCUMENTS

| | | | | | |
|---|---|---|---|---|---|
| 2,396,059 | A | * | 3/1946 | Roberts | 138/122 |
| 3,058,493 | A | * | 10/1962 | Muller | 138/122 |
| 3,189,053 | A | * | 6/1965 | Parr | 138/133 |
| 3,520,725 | A | * | 7/1970 | Hamrick | 134/21 |
| 3,866,632 | A | * | 2/1975 | Schaffer | 138/130 |
| 4,053,962 | A | | 10/1977 | McDowell | |
| 4,334,336 | A | | 6/1982 | Harbeck et al. | |
| 4,456,034 | A | * | 6/1984 | Bixby | 138/122 |
| 4,649,594 | A | | 3/1987 | Grave | |
| 4,984,328 | A | | 1/1991 | Berfield | |
| 5,345,651 | A | | 9/1994 | Roberts | |
| 5,452,493 | A | | 9/1995 | Galindo | |
| 5,613,272 | A | | 3/1997 | Huffman | |
| 6,103,971 | A | * | 8/2000 | Sato et al. | 174/47 |
| 6,108,861 | A | * | 8/2000 | Vystrcil et al. | 15/323 |
| 6,244,303 | B1 | * | 6/2001 | Adams | 138/129 |
| 6,484,357 | B1 | | 11/2002 | Dong | |
| 6,519,810 | B2 | | 2/2003 | Kim | |
| 6,820,305 | B2 | | 11/2004 | Albert et al. | |
| 7,036,184 | B2 | | 5/2006 | Kim | |
| 2002/0170140 | A1 | * | 11/2002 | Diaz et al. | 15/415.1 |
| 2005/0246854 | A1 | * | 11/2005 | Stockton | 15/323 |
| 2007/0137718 | A1 | * | 6/2007 | Rushlander et al. | 138/121 |
| 2007/0209154 | A1 | * | 9/2007 | Griffith et al. | 15/415.1 |
| 2007/0271727 | A1 | | 11/2007 | Adams | |

FOREIGN PATENT DOCUMENTS

| | | | |
|---|---|---|---|
| GB | 2223934 | A | 4/1990 |
| JP | 2001-321305 | A | 5/2000 |
| KR | 10-2004-0020139 | A | 8/2002 |

* cited by examiner

*Primary Examiner* — Lee D Wilson
*Assistant Examiner* — Tyrone V Hall, Jr.
(74) *Attorney, Agent, or Firm* — Sutton McAughan Deaver, PLLC

(57) ABSTRACT

A flexible accessory tool for a vacuum appliance is described, comprising an elongated body with a body portion having an attachment end, a nozzle end spaced apart from the attachment end and having an opening formed therein, and a flexible intermediate region for imparting flexibility to the accessory tool during use. The flexible intermediate region is made up of a rigid skeleton portion having a one or more ribs and support struts, over which a layer of non air-permeable flexible material is applied. During use, the flexible accessory tool may be bent to extreme angles in order to reach and clean debris from hard to reach areas, while not suffering from a decrease in vacuum air flow through the tool as it flexes.

15 Claims, 10 Drawing Sheets

FLEXIBLE CREVICE TOOL ATTACHMENT FOR VACUUM APPLIANCES

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to attachments for vacuum appliances. More specifically, the inventions disclosed and taught herein are related to crevice cleaning tool attachments which are adaptable for use in conjunction with a variety of vacuum cleaners.

2. Description of the Related Art

Vacuum cleaners of the type having a nozzle end and a handle end, as well as canister-type vacuum appliances like wet/dry vacuum cleaners, are generally well known in the art. When gripped by their handle ends and moved in a generally back and forth oscillatory motion, the nozzle ends of these devices trace a back-and-forth cleaning path. During such typical operation, the wrist of the hand by which the handle ends are gripped controls the trajectory of their nozzle ends. When in normal use with the hand extended straight out, the cleaning path is generally in front of the user, but when the wrists are rolled to either the right or to the left, the cleaning path traced by the nozzle ends follows the roll to the right and left of the wrist. In the case of vacuum appliances such as wet/dry vacuums, the user typically uses a vacuum hose that attaches directly to the vacuum head, allowing for collection of dirt, solid debris, and liquids in the vacuum collection drum. In this operation, the user typically moves the open end of the vacuum hose, versus the entire vacuum appliance, over the debris to be collected.

In general, these vacuum appliances perform quite well to pick up dirt, solid debris, and liquid spillage (in the case of wet/dry vacuums) immediately subjacent to their nozzle ends, whether stationery, or when moved in one of the manners described above. However, to clean areas that lie beyond the cleaning path obtained by manipulating such devices, e.g., within the crevices of wood floors, or under furniture, various attachment tools need to be employed. One type of known attachment tool is the crevice tool. Generally, such a tool includes an end for attachment to the nozzle end of a hand-held vacuum appliance or an associated vacuum hose, a nozzle end, often smaller than the nozzle end of the vacuum cleaner, and a rigid, narrow tube axially connecting the attachment and the nozzle ends in fluid-tight communication.

With the crevice tool attached, back and forth motion of the hand-held vacuum cleaner enables cleaning in small or spatially-confined areas, such as in crevices and cracks (such as the cracks between wood floor boards), as well under furniture where dust, debris, or liquids can accumulate and which do not lie in an area that is easily traced by the standard cleaning path of a vacuum cleaner. For example, U.S. Pat. No. 4,951,340 describes a multi-component crevice tool for a hand-held vacuum cleaner, the nozzle end of which may be indexed to different rotation positions so as to clean spillage in small areas defined by angular cross-sections, such as the small space between a bookshelf and a closely adjacent wall, that otherwise may not permit of ready cleaning (except, for example, by moving the bookcase away from the wall). Other approaches have included crevice tools adapted for use with a water extraction cleaning machine, and tools which incorporate a long, rubber body for flexibility. A further approach, suggested in U.S. Pat. No. 5,452,493, describes a vacuum cleaner attachment which has an attachment cylinder and a plate enclosing one end of the attachment cylinder. A semi-rigid tube is attached to and extends from a front side of the plate, and a flexible sheet is attached at a centrally located edge to a circumference portion of the attachment cylinder. A hook-and-loop type fastener is attached to outside edges of the flexible sheet so that when the back side of the attachment cylinder is placed over an end of a vacuum cleaner hose, the flexible sheet may be wrapped around the vacuum cleaner hose and the hook and loop faster may be engaged to secure the attachment cylinder in place. Ridges reportedly may be provided along a central portion of a length of the tube to adjust the rigidity to the central portion of the tube, and top and bottom scrapper wings are attached adjacent an end of the tube away from the attachment cylinder. Additional, detachable cleaning elements are also provided that have a securing cylinder of diameter larger than a diameter of the attachment cylinder to enable one end to slip fit over the attachment cylinder, the securing cylinder having axial slots to engage the wings to hold the securing cylinder in place on the attachment cylinder, and bristles carried on the securing cylinder on an end opposite the one end of the securing cylinder.

Another type of known attachment tool for use with vacuum cleaners for cleaning narrow or hard-to-reach areas is the so-called "extension wand." Generally, such a tool includes an end for attachment to the nozzle end of a hand-held vacuum cleaner, a nozzle end, and an elongated, rigid tube connecting the attachment and nozzle ends in fluid-tight communication. The reach of the vacuum cleaner is thus extended to the degree that the rigid interconnecting tube is elongated, thereby permitting cleaning of spillage and debris in areas that otherwise would lie beyond the reach of the hand-held vacuum cleaner. For example, U.S. Pat. No. 5,462,311 discloses a telescoping assembly especially suited for vacuum cleaner wands that includes a first tube having an outer diameter and a second tube having an inner diameter which is larger than the outer diameter of the first tube. In this way, the first tube fits within the second tube in an axially sliding manner. A collet is positioned within the second tube and encircles the first tube. The collet includes a locking element for selectively securing the first tube in relation to the second tube, the locking element cooperating with a portion of the second tube upon a rotation of the collet to prevent a telescoping movement of the first tube in relation to the second tube. This multi-component extension wand reportedly telescopes outward so as to clean spillage in areas that may lie at different distances.

The previously described and utilized attachment tools, however, have had their utility limited either by over-complexity, difficulty in manufacturing, shortened tool lifespan, or poor flexibility such that during operation, the amount of vacuum pressure available for cleaning is reduced.

The inventions disclosed and taught herein are directed to vacuum attachments for use with a vacuum appliance, wherein the attachments include a long, narrow extension portion that includes a flexible region having support ribs and a non air-permeable flexible material applied over the ribs, wherein the flexible region allows access of the attachment to confined areas that are not normally accessible to more rigid vacuum attachments.

BRIEF SUMMARY OF THE INVENTION

Accordingly, it is a general object of the present invention to provide a novel attachment tool for use with a vacuum appliance that overcomes the disadvantages of the heretofore known attachment tools.

In accordance with an aspect of the present disclosure, an accessory tool for a vacuum appliance is described, wherein the tool comprises a first attachment end for slidably mounting the tool to a hose assembly connected to a vacuum appliance; a second, longitudinally spaced apart nozzle end; and a self-supporting, flexible region integrally-formed with the body of the tool and intermediate between the attachment end and the nozzle end, wherein the flexible region comprises one or more support ribs.

In accordance with a further aspect of the present disclosure, a flexible accessory tool for a vacuum appliance is described, wherein the tool comprises an attachment end for slidably connecting to a hose assembly that is connected to the vacuum appliance; a nozzle end; a self-supporting, flexible region integrally formed with and intermediate between the attachment end and the nozzle end and comprising one or more support ribs forming rib spaces in between the ribs; and, a non-air-permeable flexible material extending over the one or more support ribs.

In yet another aspect of the present disclosure, a flexible accessory tool with a central axis for a vacuum appliance is described, wherein the tool comprises an attachment end for attachment to a suction means associated with the vacuum appliance; a nozzle opening spaced longitudinally apart from the attachment end and along the central axis; and, an elongated, spiral portion positioned intermediate between the attachment end and the nozzle opening, wherein the spiral portion comprises a continuous rib formed in a helix shape, converging towards the central axis.

In a further aspect of the present disclosure, a process of manufacturing an accessory as described herein, such as a flexible accessory tool, is described, wherein the process comprises forming a body component comprising an attachment end, a laterally spaced-apart nozzle end, and an elongated flexing region spaced intermediate between the attachment end and the nozzle end, wherein the elongated flexing region comprises one or more support ribs forming a plurality of rib spaces; and, over-molding an elastomeric material over at least the outer surface of the elongated flexing region using vacuum-assisted pressure, such that at least a portion of the elastomeric material is drawn into and between the plurality of rib spaces, in the direction of the central axis of the tool body.

In further accordance with aspects of the present disclosure, an accessory tool for a vacuum appliance is described, wherein the tool comprises a hollow, tubular body portion with a working air passageway formed therein about a central longitudinal axis and having an attachment end for attachment to a vacuum appliance; an elongated, tapered body region extending from one end of the tubular body portion; a nozzle opening located at the end opposite the attachment end for the fluid uptake of debris-containing air into the working air passageway of the tool; and, an elongated flexing region intermediate spaced intermediate between the tapered body region and the nozzle opening, wherein the elongated flexing region comprises one or more support ribs forming a plurality of rib spaces. In accordance with this aspect of the disclosure, the tool may further comprise an elastomeric material overmolded over the outer surface of the elongated flexing region, wherein the elastomer is selected from the group consisting of rubbers, polypropylene, polyurethane, and thermoplastic elastomers. The accessory tool in accordance with this aspect of the disclosure can have up to and including 360° of flexibility about the central axis extending through the tool without decreasing the vacuum flow through the tool, and/or the elongated flexing region may be laterally bendable about the central axis extending through the tool about a radius ranging from about 0° to about 45° without decreasing the vacuum flow through the tool.

In accordance with yet another aspect of the present disclosure, a wet/dry vacuum kit is described, wherein the kit comprises a wet/dry vacuum appliance, a flexible hose having a female connector on one end and a male connector on a second, opposite end, and an accessory tool for use with the vacuum appliance. In accordance with this aspect of the disclosure, the accessory tool may comprise an elongated, generally tubular body; an attachment end for slidably mounting to a hose assembly connected to the vacuum appliance; a nozzle end spaced apart from the attachment end and having an air flow entrance; and a self-supporting, flexible region integrally formed between the attachment end and the nozzle end, wherein the flexible region comprises one or more support ribs. In a further embodiment of this aspect of the disclosure, the kit may further include an elongated extension tube having a female connector on one end and a male connector on a second, opposite end.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
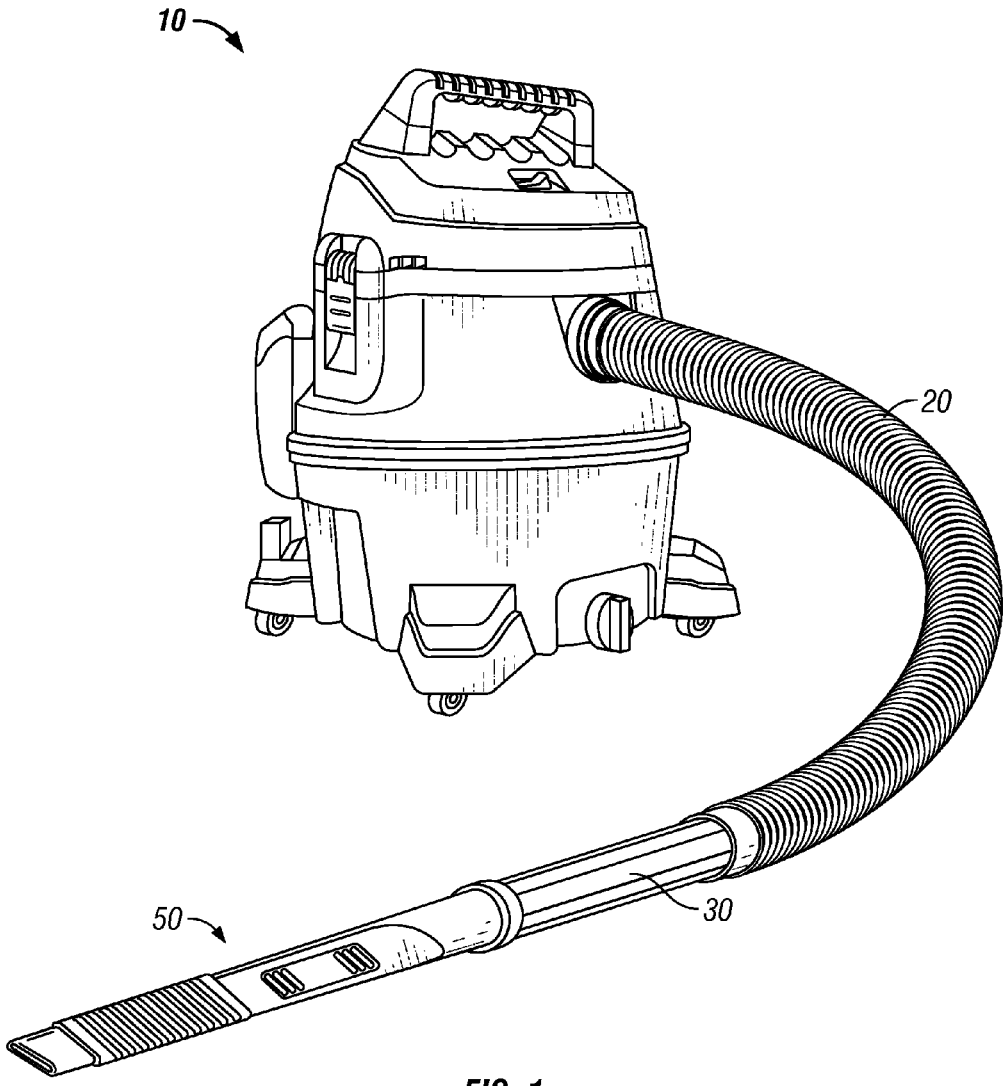
FIG. 1 illustrates a perspective view of an exemplary vacuum appliance incorporating a flexible crevice accessory cleaning tool in accordance with the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created flexible crevice tool accessories for use with a vacuum appliance, wherein the tool comprises an elongated body having an attachment end for attachment to a vacuum appliance or a suction hose or equivalent suction means in vacuum communication with a vacuum appliance, a nozzle opening spaced longitudinally apart from the attachment end along a central axis, and a flexible body region spaced in between the attachment end and the nozzle opening, wherein the flexible body region comprises a support skeleton section having one or more formed ribs which in turn have a portion of flexible material applied over their outer surface, such that the rigid skeleton provides support for the tool and prevents the flexible material from collapsing and closing off the flow of air during use, while simultaneously maintaining a wide degree of tool flexibility.

Turning now to the figures, FIG. 1 illustrates a perspective view of an exemplary vacuum appliance 10 with a collection drum incorporating a flexible crevice accessory cleaning tool 50, in accordance with the present disclosure. The flexible crevice tool 50 may be coupled directly to a suction means such as flexible vacuum hose 20 attached to a vacuum inlet of a vacuum appliance, such as a wet/dry vacuum, or to an optional hose extension wand 30 which can be inserted intermediate between a vacuum hose 20 and the tool 50, via any appropriate coupling method, such as via frictional attachment, threaded attachment, or the like. While the figure illustrates a wet/dry vacuum appliance 10, it will be realized that the flexible crevice tools 50 as described herein may be used in association with any of a number of types of vacuum appliances, including but not limited to upright vacuum cleaners, backpack vacuum cleaners, hand-held vacuum cleaners, wall-mounted vacuum cleaners, canister-type vacuum cleaners, and central-vacuum systems.

Figure 2A:
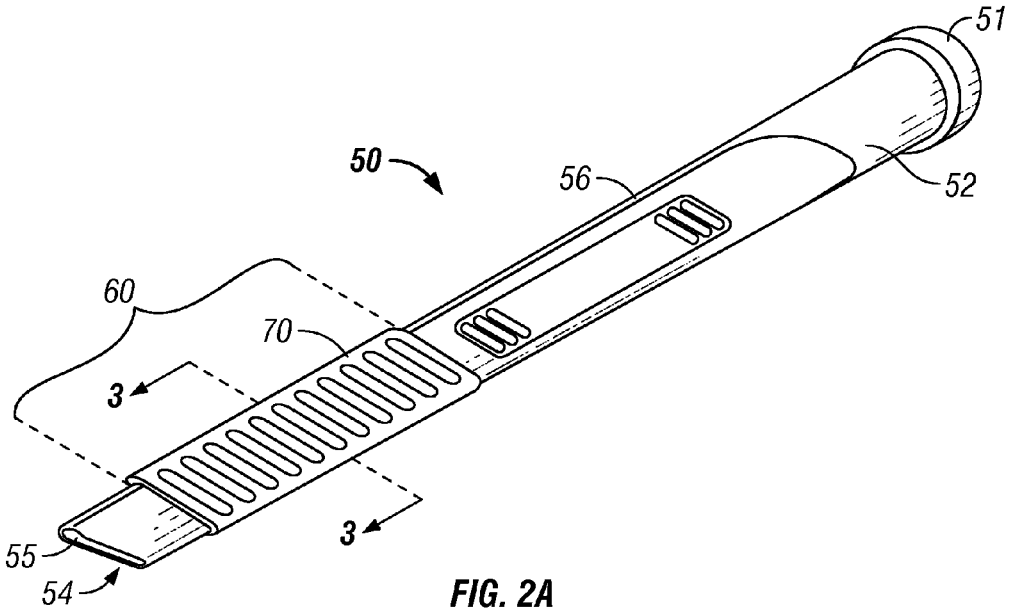
FIG. 2A illustrates a perspective view of an exemplary flexible crevice accessory cleaning tool.
Figure 2B:
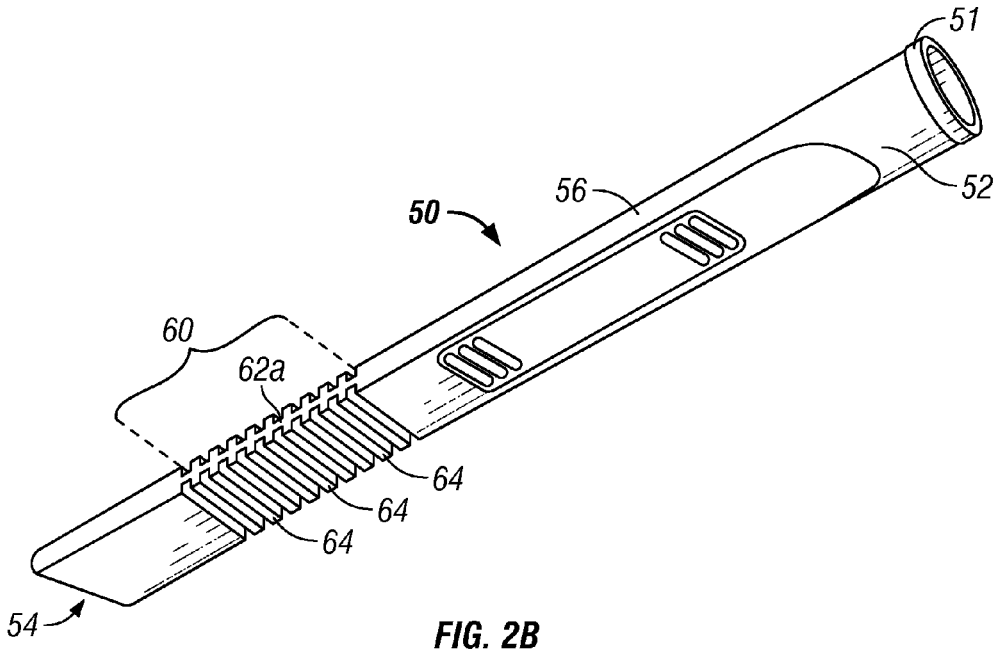
FIG. 2B illustrates a perspective view of the tool of FIG. 2A with the flexible layer removed.

The details of an exemplary flexible crevice tool 50 in accordance with the present disclosure is illustrated in FIG. 2A and FIG. 2B. As illustrated generally in the Figure, flexible crevice tool 50 comprises an at least partially elongated, generally tubular-shaped body having an attachment end 52, a spaced apart nozzle end 54 comprising a nozzle opening 55 which acts as the primary air flow intake channel during use in association with a vacuum appliance, and a flexible region 60 spaced intermediate between the nozzle end 54 and the attachment end 52. In accordance with certain aspects of the present disclosure, the attachment end 52 may include an elongated, tapered body region 56 extending from the region near the attachment end 52 of the tubular body portion toward the nozzle end 54, such that the outer opening of the attachment end is larger than the mouth of nozzle opening 55 , of the nozzle end 54 of the crevice tool. Attachment end 52 is also illustrated to be a female-type connection end having a cylindrical opening that is capable of receiving a male connection end of a hose extension, flexible hose 20, or the like. The attachment end 52 as illustrated in the Figures may have a smooth surface, such that when a similarly smooth surfaced male connector (i.e., to the male connection end of an extension wand 30) is placed inside the smooth surfaced female receptor region of attachment end 52, a friction-type fit is formed, which becomes a strong hold when a vacuum source is applied during the course of operation of a system such as described herein. In addition, while it is not illustrated in the figure, the female-type attachment end 52 of tool 50 (on their inner surfaces), as well as on the outer surfaces of their corresponding male connectors, may have irregularities such as ridges or recesses along their circumferences or longitudinally, so as to provide a gripping means for securing the two devices together while at the same time allowing for a quick release of the tool 50 from the male connection end of the hose or extension wand by the user.

With continued reference to the perspective views of the embodiment of tool 50 in FIGS. 2A and 2B, flexible region 60 comprises a "support skeleton" comprising one or more support spines 62 (such as top and bottom support spines 62*a*, 62*b*) and a plurality of support ribs 64, which are covered by a flexible layer or portion, 70. As may be seen in the perspective view of FIGS. 2A and 2B, nozzle end 54 has a narrower orifice/air flow intake channel size than the opposite, attachment end 52, this narrowing acting to increase the suction of the vacuum air flow up, into and through tool 50. Similarly, a tapered transition portion 56 may be optionally included between the flexible region 60 and the attachment end 52 as described above, so as to alter the cross-sectional area of the air flow channel 40 within the crevice tool 50 and further increase the suction of vacuum through the tool. The attachment end 52 of the flexible crevice tool may also comprise a raised collar region 51 to aid the user in attaching and removing the tool from a vacuum appliance after use.

Figure 3:
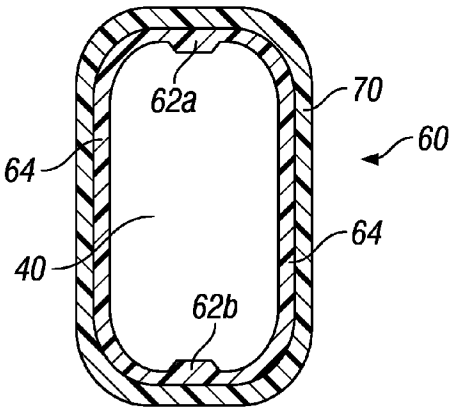
FIG.3 illustrates a cross-sectional view taken along line 3-3 of FIG.2A.

FIG. 3 illustrates a cross-sectional view taken along line 3-3 of FIG. 2A, and shows that this embodiment of the flexible crevice tool 50 exhibits a generally oval-like cross sectional configuration, although other cross-sectional configurations may be possible, including circular, rectangular, and trapezoidal, without limitation. As shown in the figure, a central air flow channel 40 within the center line "C" of tool 50 is defined in the flexible region 60 of the tool between the attachment end 52 and the nozzle end 54 by the support skeleton of the flexible region, comprising ribs 64 and upper and lower spine sections 62. Air flow channel 40 is further defined by flexible portion 70, which both covers the exterior surface of ribs 64 and support spines 62, and in certain aspects of the disclosure (depending on the material which makes up flexible portion 70), fills the rib spaces formed by the plurality of ribs 64.

Figure 4:
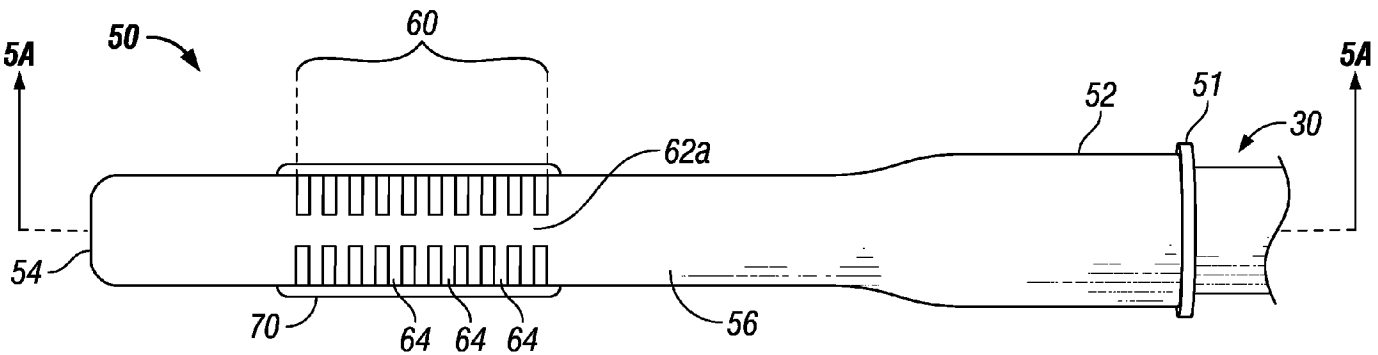
FIG. 4 illustrates a top plan view of the flexible crevice accessory cleaning tool of FIG.2.

FIG. 4 illustrates a top plan view of the flexible crevice accessory cleaning tool of FIGS. 2A-2B slidably attached to a male connection end of an extension wand 30, showing in more detail the support skeleton of flexible region 60 with flexible portion 70 (shown in hashed lines for purpose of clarity). As can be seen in the figure, flexible region 60 can be comprised of at least one central spine 62 extending between the nozzle end 54 and the tapered, transition body region 56 and/or the attachment end 52, and a plurality of support ribs 64. In accordance with this aspect of the disclosure, ribs 64 are spaced apart in such a manner that they preferably comprise a plurality of substantially equally-spaced rib spaces intermediate between each of the ribs 64.

In accordance with the present disclosure, the tool body and skeleton, which includes the flexible region (including support spine(s) 62 and ribs 64), the nozzle opening 54, and the attachment end 52, are preferably formed of a semi-rigid material, including metal, metal alloys, or a polymeric or plastic resinous material, such as polypropylene, polystyrene, polycarbonate, ABS (acrylonitrile butadiene styrene), SAN (styrene acrylonitrile), PET (polyethylene terephthalate), copolymers thereof, or the like, by a process of extrusion, mold forming, or other appropriate methods known in the art.

Figure 5A:
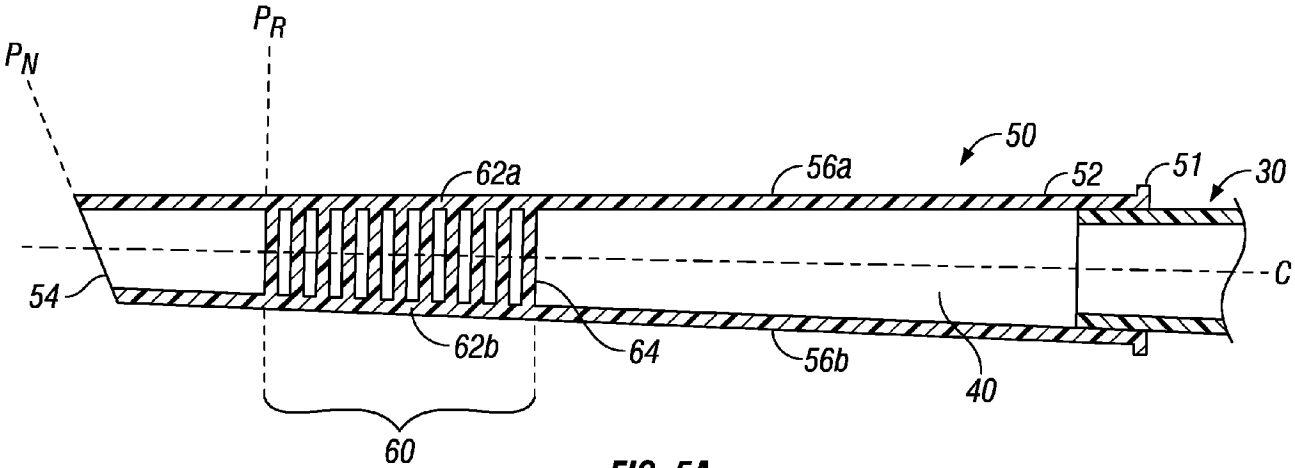
FIG. 5A illustrates a cross-sectional view, taken along line 5A-5A of FIG. 4.
Figure 5B:
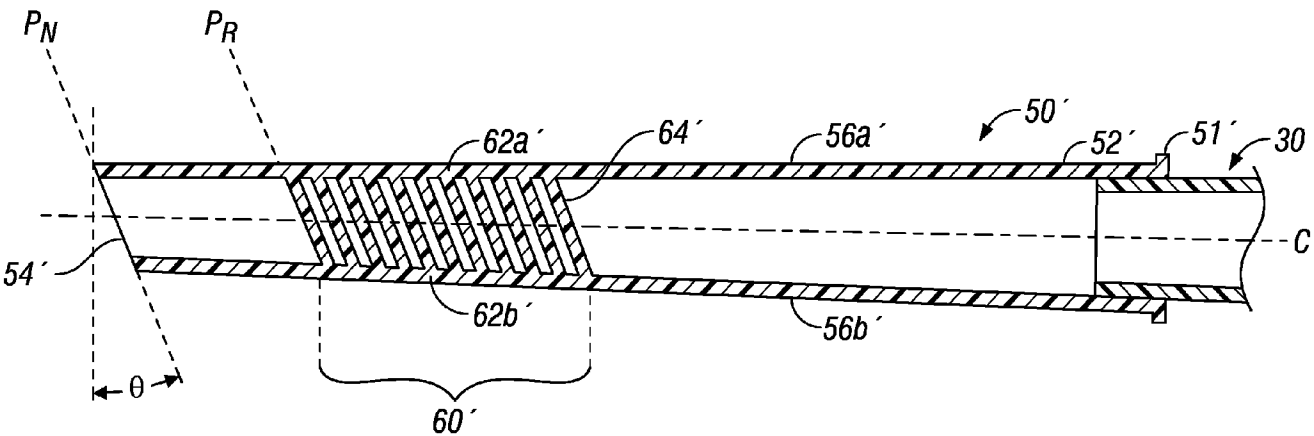
FIG. 5B illustrates a cross-sectional view of an alternative configuration of the tool of FIG.2A.

In FIG. 5A, a cross-sectional view, taken along line 5A-5A of the tool of FIG. 4 is shown slidably and frictionally attached at female attachment end 52 to the tapered male end of an extension wand 30. As illustrated therein, the ribs 64 and support spines 62 of the flexible region 60 of crevice tool 50 may be oriented in a manner such that the ribs 64 are oriented substantially parallel to each other, such parallel orientation defining a plane $P_R$. The ribs 64 in the embodiment illustrated in FIG. 5A may also be oriented substantially perpendicular to the support spine(s) 62*a*, 62*b*, as well as to the central axis 'C' extending through the center of tool 50. As further shown in the embodiment illustrated in this figure, the ribs 64 defining a plane $P_R$ are substantially parallel to each other in plane $P_R$, but are out of parallel/out of plane with the plane defined by the taper of nozzle end 54, $P_N$. FIG. 5B illustrates a cross-sectional view of an alternative configuration of the tool of FIG. 2A, crevice tool 50', similarly frictionally attached at female attachment end 52' to the tapered male end of an extension wand 30. In the embodiment illustrated in FIG. 5B, the ribs 64' may be formed such that they are oriented in a plane $P_R$ that is non-perpendicular to both support spines 62*a*', 62*b*' and central axis C extending through the center of tool 50'. As is additionally shown in the embodiment illustrated in this figure, the ribs 64' defining a plane $P_R$ are substantially parallel to each other in plane $P_R$, and are simultaneously substantially parallel to/in plane with the plane defined by the taper of nozzle end 54', $P_N$. The angle θ of plane PN in both FIG. 5A and 5B relative to a line perpendicular to the central axis 'C' may range from about 5° to about 80°, preferably from about 20° to about 65°, without limitation.

Figure 6A:
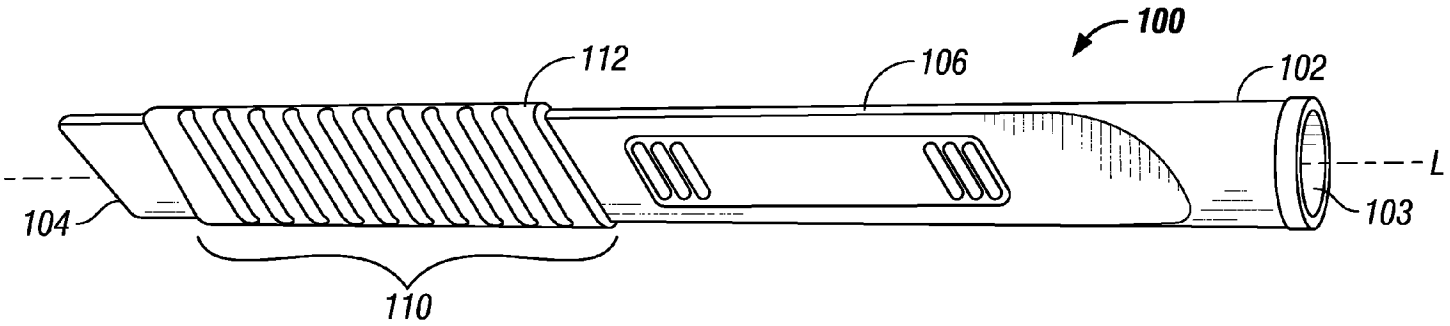
FIG. 6A illustrates a perspective view of a further exemplary crevice accessory cleaning tool in accordance with the present disclosure.
Figure 6B:
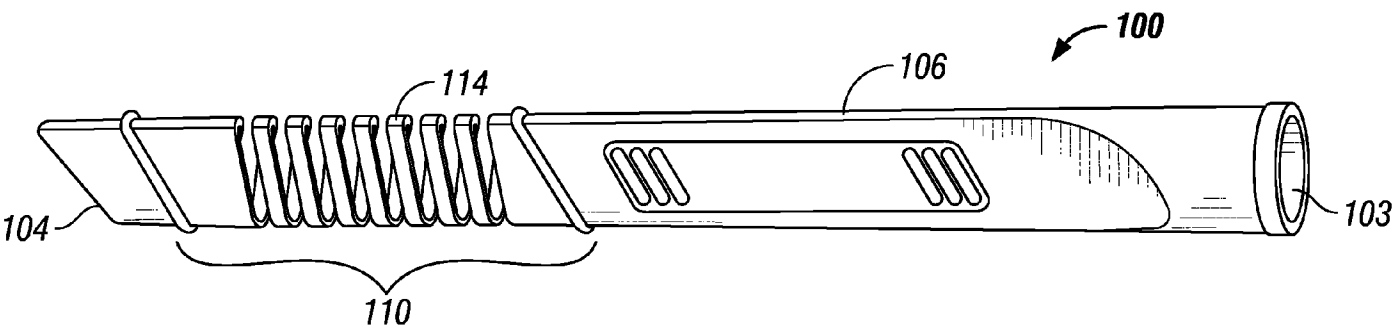
FIG. 6B illustrates a perspective view of the tool of FIG. 6A with the over-molding region removed.
Figure 6C:
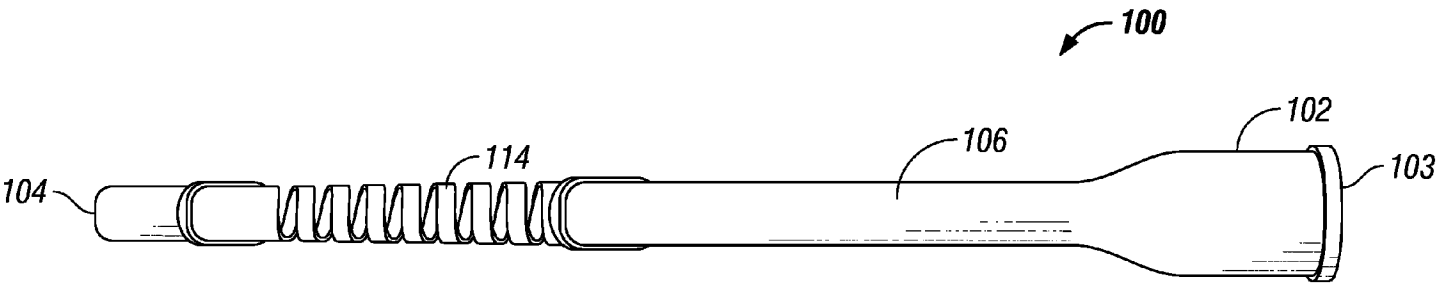
FIG. 6C illustrates a top view of the tool of FIG. 6A, with the over-molding removed.
Figure 6D:
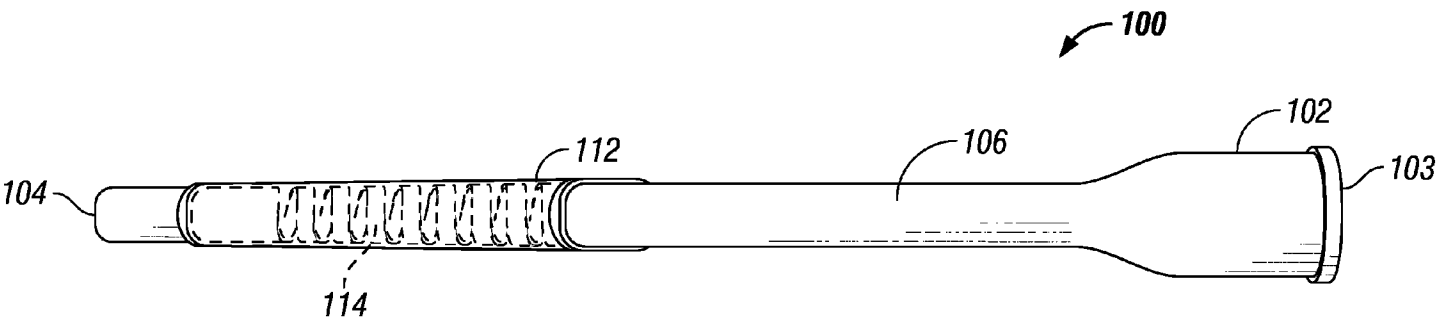
FIG. 6D illustrates a top view of the tool of FIG. 6A.
Figure 6E:
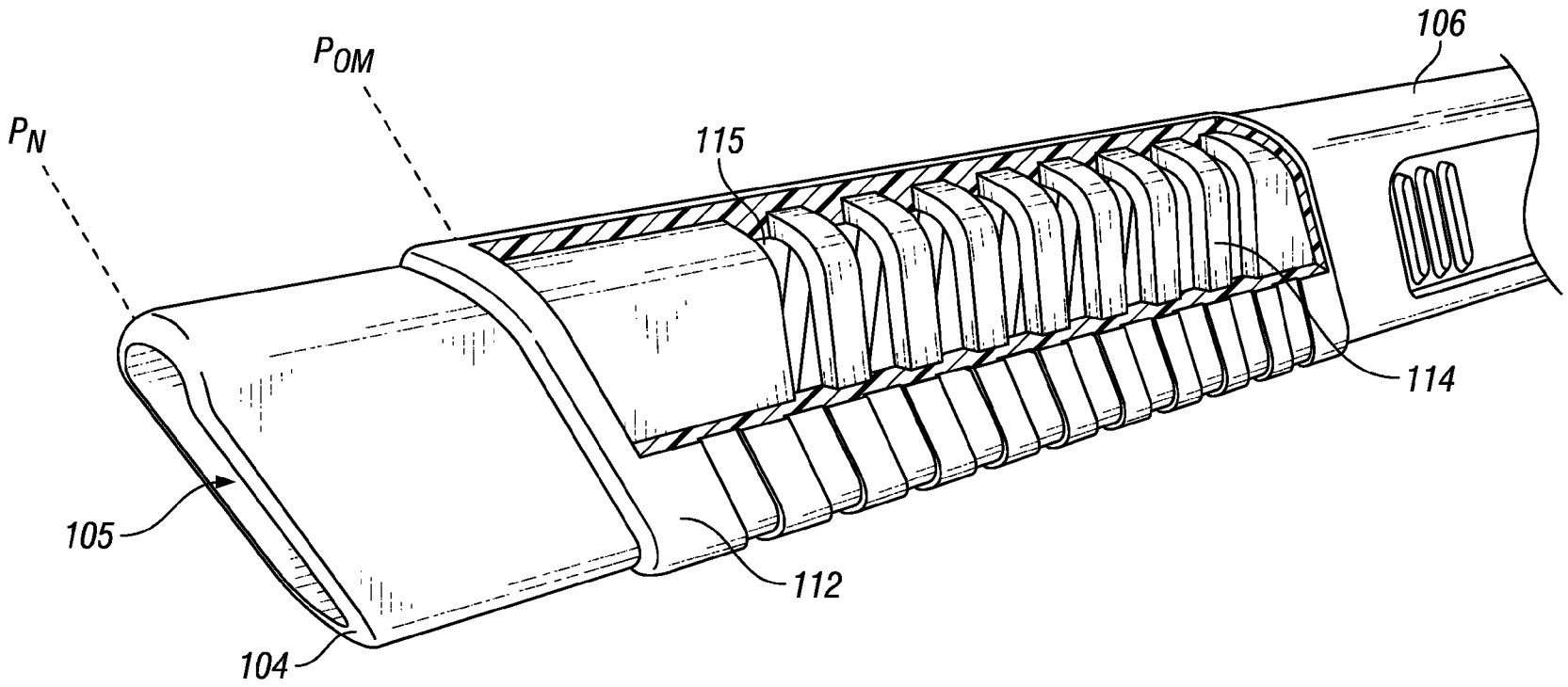
FIG. 6E illustrates a partial cut-away view of the front region of the tool illustrated in FIG. 6A.

An alternative, yet equally acceptable embodiment of the present disclosure is shown in FIGS. 6A-6E, which illustrates a perspective view of flexible crevice accessory cleaning tool 100. Tool 100 comprises an elongated body having a generally tubular attachment end 102 (which may be male or female, although female is preferred, as illustrated), an optional elongated, tapering transition body region 106 extending from the region near the attachment end 102 of the tubular body portion toward the nozzle end 104 and having a cross-sectional diameter less than the diameter of the opening of attachment end 102, a flexing region 110 comprising a generally helical rib assembly and flexible cover portion 112 (such as an elastomeric over mold), and nozzle end 104 having a nozzle opening 105, wherein attachment end 102 and nozzle end 104 are oppositely spaced apart along central axis L of tool 100. As is illustrated in the figures, the flexing region 110 may comprise a single, generally helix-shaped rib 114, or may further comprise two or more helically-shaped ribs (not shown), as appropriate. The helix-shaped rib region 114 is illustrated more clearly in the side view of tool 100 in FIG. 6B, as well as in the bottom view of tool 100 shown in FIG. 6C. The partial cut-away view of FIG. 6E illustrates an example of the substantially parallel relationship between the plane of the nozzle end ($P_N$) and the plane of the lower end of the flexible cover portion 112, $P_{OM}$. As may also be seen in this cut-away view, when flexible cover portion 112 is an over-molded elastomer or an equivalent material, the elastomeric material not only covers the outer surface of the ribs 114, but also extends inwardly between the individual ribs into rib space 115, adding extra strength and durability to the flexing region of the tool. While not shown in the figure, but in a manner similar to the flexible tool 50 described above, ribs 114 may define a plane $P_R$ that is either substantially parallel to the plane $P_N$, or is non-parallel to the plane $P_N$. Both of these arrangements are acceptable, and may be determined by such considerations as design requirements, manufacturability, and the like.

Figure 7:
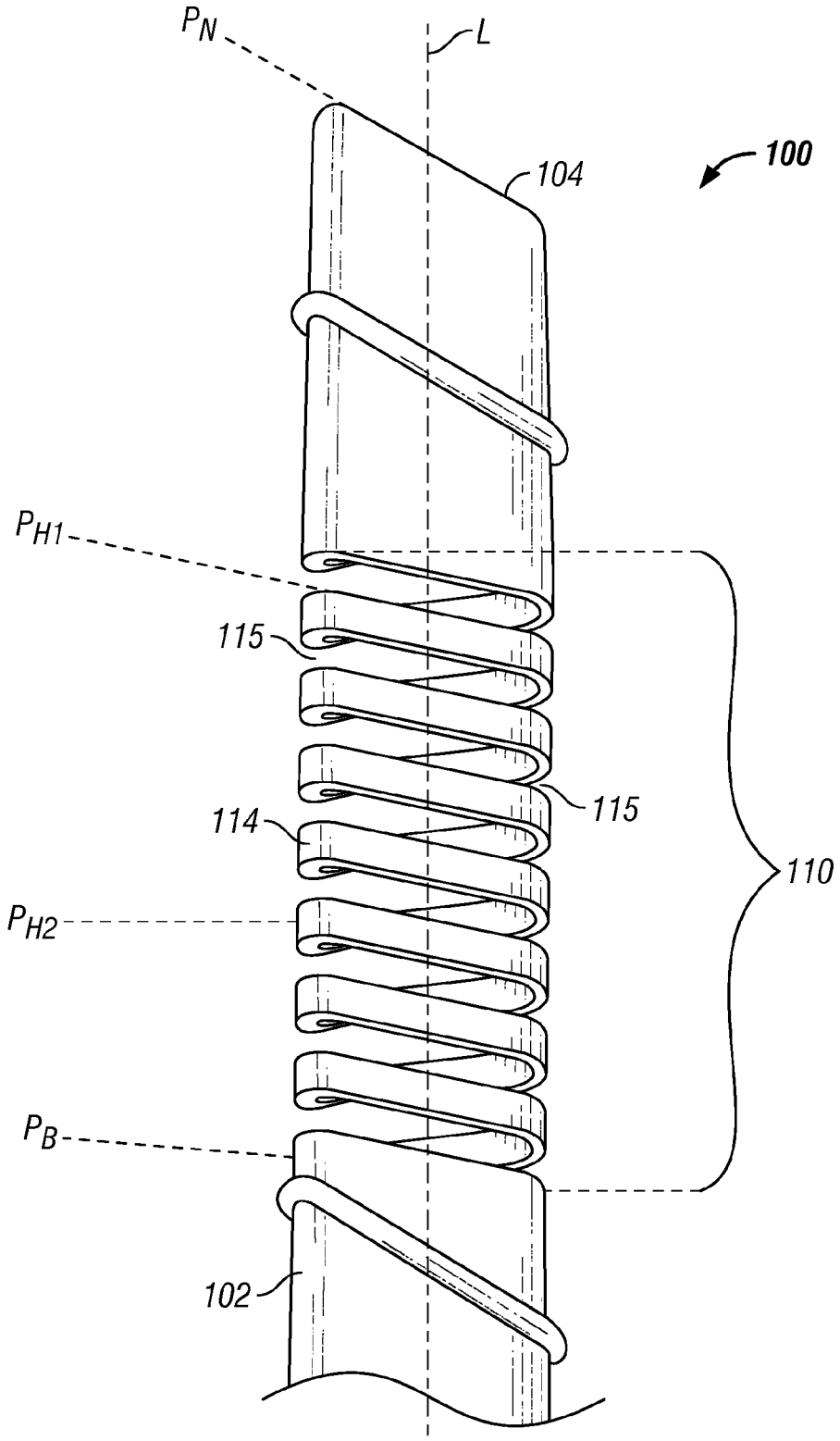
FIG. 7 illustrates a partial side detailed view of the cleaning tool of FIG. 6B.

FIG. 7 illustrates a side view of the cleaning tool of FIG. 6, without the flexible cover portion 112 applied for purpose of clarity. As shown therein, helix-shaped rib 114 is formed generally in the shape of a helix, which may (but need not) converge in a direction from the attachment end 102 towards the nozzle end 104 along its own central axis L. As illustrated in the figure, the helix-shaped rib 114 forms a plurality of circumferential rib spaces 115 along substantially the entire elongated portion of flexing region 110. The figure also illustrates a number of geometric planes defined by regions of the tool 100 and the helix-shaped rib of the flex region, wherein $P_N$ is the plane of the nozzle end 104, $P_{H1}$ is a first plane of the helical coil 114, $P_{H2}$ is a second plane of the helical coil 114, and $P_B$ is the plane of the body of the flexible crevice tool 100, all of which are described in reference to the central axis L of tool 100. The ribs 114 of the helix may be formed such that they line in a series of planes that are substantially parallel to the plane of the nozzle end, such that $P_{H1}$ and $P_N$ are substantially parallel; alternatively, and equally acceptable, the ribs 114 (and associated spaces 115 formed by the ribs) may be in a series of planes that are substantially parallel to the plane of the tool body, such that $P_{H2}$ is substantially parallel to $P_B$.

Figure 8:
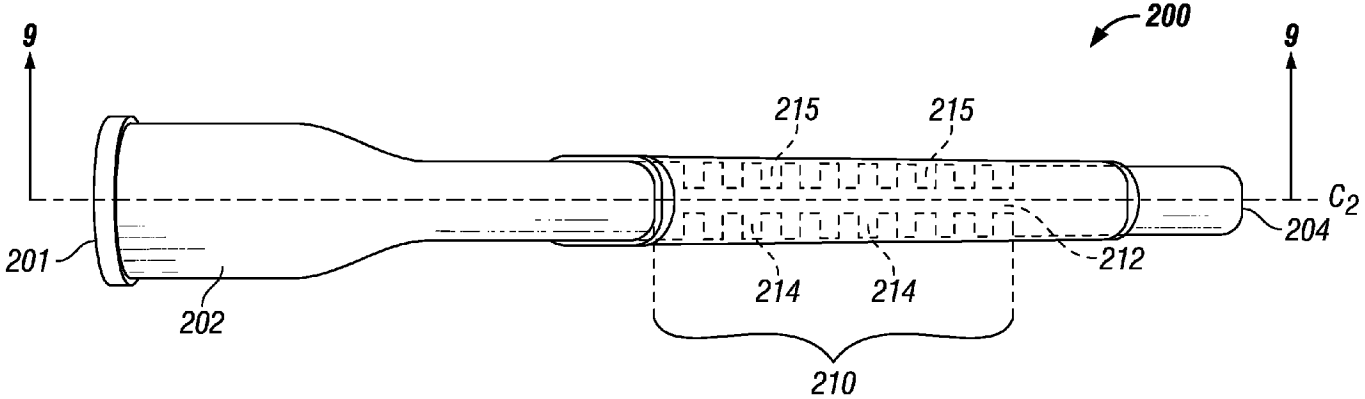
FIG. 8 illustrates a top plan view of a further exemplary crevice accessory cleaning tool in accordance with the present disclosure.
Figure 9:
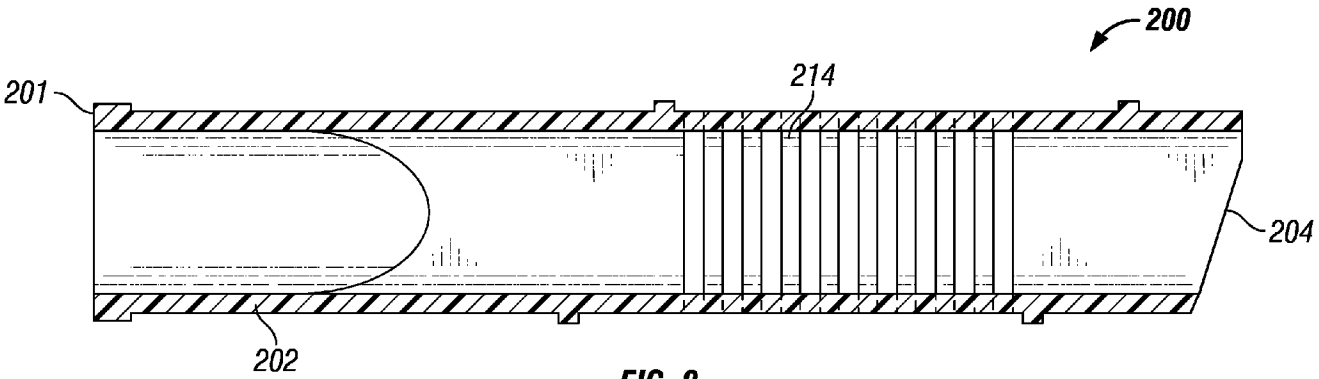
FIG. 9 illustrates a cross-sectional view of the tool of FIG. 8, taken along line 9-9.

In FIG. 8 and FIG. 9, alternative flexible crevice tool embodiments of the present disclosure are illustrated, showing crevice tool 200 with a shortened body in comparison with the elongated tools 50 and 100, detailed herein. In the top view of flexible crevice tool 200 of FIG. 8, it can be seen that the tool 200 lacks an extended transition region (such as taper region 56) and comprises an attachment end 202 with a collar portion 201 for slidably mounting the tool 200 to a hose assembly connected to a vacuum appliance in a friction-fit type arrangement, an opposite nozzle end 204 along a central axis $C_2$, and a self-supporting, flexible region 210. The flexible region 210 may be integrally formed with and intermediate between the attachment end 202 and the nozzle end 204. Similar to the previous embodiments of the present disclosure, wherein the flexible region comprises one or more support ribs in the support skeleton of support region, flexible region 210 of tool 200 also comprises a support skeleton comprising at least an upper and lower spine section 212, and a plurality of spaced-apart support ribs 214 which form rib spaces 215. This is shown more clearly in the cross-sectional view of FIG. 8, taken along line 9-9. While illustrated in hashed lines in FIG. 8 for purposes of clarity, crevice tool 200 also comprises a flexible cover portion 216, which may be of any appropriate material as discussed herein. In accordance with one aspect of the present disclosure, the flexible cover portion (or layer) 216 which covers the outer surface of ribs 214 within flexible region 210 is an over-molded elastomeric material which is vacuum overmolded from the connection end 202 towards the nozzle end 204 using a vacuum pressure sufficient to create an airtight overmold that covers the region 210, and draws the elastomeric material comprising the overmold onto the outer surface of ribs 214 and alternatively, into the spaces between ribs 214 for improved sealing. This method of application of a overmolded elastomeric material may be applied to any of the flexible crevice tool assemblies of the present disclosure.

Figure 10B:
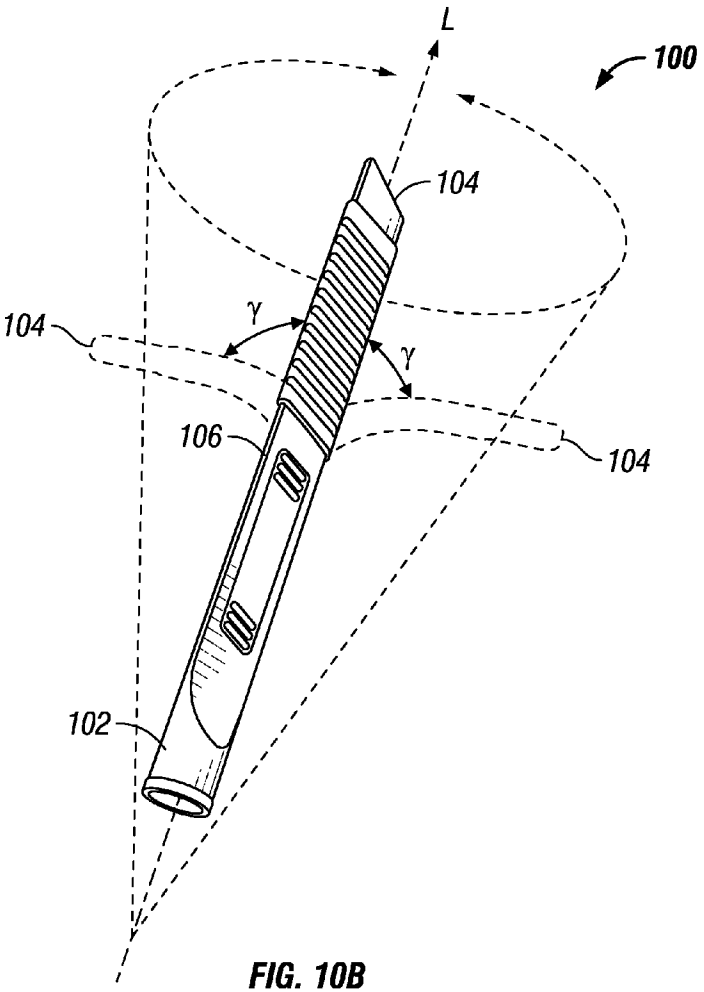
FIG. 10B illustrates a perspective view of the flexible crevice tool of FIG. 6, illustrating the combined lateral and circumferential flexing ability of the tool.
Figure 10A:
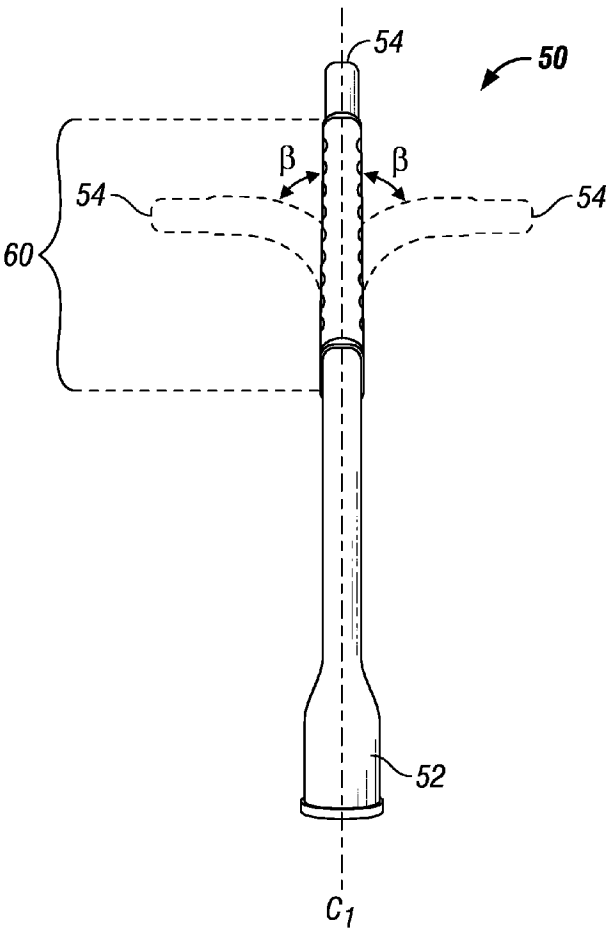
FIG. 10A illustrates a top-down view of the flexible crevice tool of FIG. 2, illustrating the lateral flexing ability of the tool.

The elongated flexing regions of the crevice tools 50, 100, and 200 as illustrated herein act to provide flexibility to the tools as needed during the use in vacuum operations, such as to allow the user to insert the tool into hard-to-reach or narrow spaces during cleaning. This is illustrated in FIGS. 10A and 10B, which illustrate the flexing of crevice tools 50 and 100, respectively, in multiple directions, as indicated by the hashed lines. As shown in FIG. 10A, the elongated flexing region 60 of crevice tool 50 is capable of being flexed laterally (side-to-side) such that the longitudinal central axis $C_1$ extending through the tool, as measured at the nozzle opening 54, may be flexed during use to a lateral bend angle β ranging from about 1° to about 120° with respect to axis $C_1$, including lateral bend angles within this range, such as from about 5°to about 100°, or from about 5°to about 90°, without limitation. During such a flexing motion in the course of use of the tool 50, the crevice tool is not only not broken or kinked as a result of the structure of the flexing region 60 in combination with the flexible layer 70, but advantageously allows for the vacuum flow rate of solid or liquid debris from a surface through the crevice tool to the debris holding portion of a vacuum appliance to remain substantially unchanged, as the cross-sectional interior area does not decrease during operation, even when the tool is flexed to the farthest extent of its operational ranges (e.g., flexed laterally up to 120°). Similarly, as illustrated in FIG. 10B, the elongated, helical flexing region 110 of flexible crevice tool 100 can be flexed both circumferentially and laterally about its central axis L. In particular, the tool 100 may be flexed during use to a lateral bend angle γ ranging from about 1° to an angle greater than about 90°, such as from about 0.5° to about 120° (without limitation), and simultaneously may be flexed or rotated circumferentially up to 360° about its central axis L. As with flexible crevice tool 50 described above, during such flexing and/or rotating motions in the course of use of the tool 100, the crevice tool 100 is not only not broken or kinked as a result of the structure of the helical flexing region 110 in combination with the flexible layer 112, but also allows for the vacuum flow rate of solid or liquid debris from a surface through the crevice tool to remain substantially unchanged.

As indicated above, flexible layer 70/112 may be any material which forms a non-air permeable skin over the flex structure of the tool, including but not limited to non-air permeable canvas and/or cloth materials, non-air permeable plastic materials, non-air permeable paper-type materials, and elastomeric materials, preferably elastomeric materials which are non-air permeable. In accordance with one preferred aspect of the present disclosure, the flexible layer 70 is an elastomeric material which is over-molded over the flexible skeleton portion of the crevice tool.

Elastomeric materials which may be used to form the flexible layer 70 include (but are not limited to) those elastomers with a density (or specific gravity) less than about 1.0, and/or have specific characteristics making them ideal for their use herein, including but not limited to glass transition temperature ($T_g$), tensile strength, and elongation at break. Exemplary polymers and rubbers suitable for use with the present invention as elastomers include but are not limited to synthetic polyisoprene (IR), butyl rubbers, polybutadiene (BR), styrene-butadiene rubbers, chloroprene rubbers, polyacrylic rubbers (ACM), silicon rubbers, fluorsilicone rubbers such as FVMQ (fluorovinyl Methyl Silioxane), and nitrile rubbers such as Buna-N, hydrogenated nitrile rubbers, and nitrile butadiene rubber (NBR); polypropylenes; polyurethanes; polyolefin elastomers, such as copolymers of ethylene, butane, and 1 or 2 octene; copolymers of ethylene and trans 2-butene; syndiotactic polyethylene; isotactic polyethylene; water borne acrylics; latexes; and thermoplastic compounds, including thermoplastic polyoctene compounded with talc or titanium dioxide, thermoplastic elastomers compounded with thermoplastic polymers, thermoplastic polyurethane elastomers and thermoplastic elastomers (TPE) alone or compounded with thermoset polymers.

In accordance with certain aspects of the present disclosure, elastomers which may be used within the present invention include thermoplastic polyurethane elastomers having a low melt viscosity, low density, and a low glass-transition temperature. Such elastomers include but are not limited to VERSOLLAN™ and VERSOLLAN™ TPE (Thermoplastic Polyurethane Elastomers), DYNAFLEX™, VERSAFLEX™ CL2003X, and VERSAFLEX™ CL 2000X (polyurea elastomers manufactured by VersaFlex, Inc., Kansas City, Kans.), all available from GLS Corporation (McHenry, Ill., USA), as well as KRATON™ styrenic block copolymer elastomers available from Kraton Polymers, LLC (Houston, Tex.). Also suitable for use as elastomers for use within the present invention are those elastomers that are soluble in high molecular weight (e.g., $C_9$-$C_{16}$) hydrocarbons, such as the ENGAGE™ polyolefin elastomers ENGAGE™ 8407, ENGAGE™ 8402, ENGAGE™ 8842, and ENGAGE™ 7467, all from DuPont Dow Elastomers, LLC (Wilmington, Del., USA). Specifically preferred for use herein are VERSAFLEX™ thermoplastic polyurea elastomers, such as VERSAFLEX™ CL2000X [which has a density of 0.87 g/cm$^3$ and a tensile strength of 1724 kpa], and the polyolefin EGAGE™ elastomers such as ENGAGE™ 7467 [which has a density of 0.862 g/cm$^3$ and a tensile strength of 2.6 MPa].

In accordance with certain aspects of the present disclosure, elastomers suitable for use with the present invention in forming flexible layers 70,112 of the vacuum accessory tools described herein have a melt index (as measured according to, for example, ASTM D-1238) from about 0.2 dg/min (degrees per minute, as measured at 190° C. and 2.16 kg) to about 40.0 dg/min, and more preferably from about 1.0 dg/min to about 40.0 dg/min. Most preferably, elastomers suitable for use with the present invention have a melt index from about 1.0 dg/min to about 30.0 dg/min.

Elastomers suitable for use with the present invention may also be characterized as having a density range (as measured by, for example, ASTM D-792) from about 0.500 g/cm$^3$ to about 1.000 g/cm$^3$, and preferably have a density range from about 0.700 g/cm$^3$ to about 1.000 g/cm$^3$. More preferably, in accordance with certain aspects of the present disclosure, the elastomers suitable for use within the present invention may have a density from about 0.710 g/cm$^3$ to about 0.990 g/cm$^3$. For example, elastomers having a density of about 0.70 g/cm$^3$, 0.71 g/cm$^3$, 0.72 g/cm$^3$, 0.73 g/cm$^3$, 0.74 g/cm$^3$, 0.75 g/cm$^3$, 0.76 g/cm$^3$, 0.77 g/cm$^3$, 0.78 g/cm$^3$, 0.79 g/cm$^3$, 0.80 g/cm$^3$, 0.81 g/cm$^3$, 0.82 g/cm$^3$, 0.83 g/cm$^3$, 0.84 g/cm$^3$, 0.85 g/cm$^3$, 0.86 g/cm$^3$, 0.87 g/cm$^3$, 0.88 g/cm$^3$, 0.89 g/cm$^3$, 0.90 g/cm$^3$, 0.92 g/cm$^3$, 0.94 g/cm$^3$, 0.96 g/cm$^3$, 0.99 g/cm$^3$, and densities between any two of these values (e.g., between 0.80 g/cm$^3$ and 0.90 g/cm$^3$) are suitable for use with the present invention.

Elastomers suitable for use within the present invention may also optionally be characterized as having a certain glass transition temperature $T_g$, preferably having a glass transition temperature, $T_g$, such that the temperature at which there is an increase in the thermal expansion coefficient of the elastomer is less than about 600° F., preferably from about 100° F. to about 500° F., as well as in ranges of temperature within this range. For example, and without limitation, elastomers suitable for use with the present invention in accordance with certain aspects of the disclosure have a useable temperature range such that the lower end of the $T_g$ is about 120° F. and the upper end of the $T_g$ is about 250° F. (low temperature elastomers). Also suitable for use within the present invention, the elastomers can have a usable temperature range such that the lower end of the $T_g$ is about 180° F. and the upper end of the $T_g$ is about 500° F. (high temperature elastomers).

Additionally, the elastomers suitable for use within the present invention may optionally be characterized as having particular tensile strength characteristics. In accordance with this aspect of the disclosure, the elastomers suitable for use as outer flexible layers (e.g., 70, 112) preferably have a tensile strength greater than about 10 Pa, and more preferably greater than about 1 kPa. As used herein, the term "tensile strength" refers to the maximum amount of tensile stress that can be applied to the elastomeric material before it ceases to be elastic, measured in units of force per unit area (N/m$^2$ or Pa) according to ASTM-standard D-638, ASTM D-412, or ISO 37 (available from the world wide web at astm.org).

A further distinguishing property of the elastomers suitable for use in the present invention is the "elongation at break" property. As used herein, the term "elongation at break" refers to the elongation recorded at the moment of rupture of the specimen, often expressed as a percentage of the original length; it corresponds to the breaking or maximum load, as measured by ASTM D-412 or ISO 37 (available from the world wide web at astm.org) and expressed as a percentage (%). Preferably, and in accordance with the present invention, elastomers used herein may have an elongation at break of greater than about 250%.

In use, the accessory crevice tool 50 (or 100, or 200) is mounted and coupled to the end of a vacuum appliance hose, such as vacuum hose 20 attached to vacuum 10 as shown in FIG. 1, by way of a friction fit between the friction fit between the attachment end (e.g., 52) of the tool 50 and the male end of the vacuum hose 20, or alternatively and equally acceptable, an extension wand 30. When the vacuum appliance is turned on for operation, the vacuum force inward from the nozzle end 54 towards vacuum appliance 10 results in stronger friction-type fitting. The user may then operate the vacuum appliance in a typical manner, inserting the flexible tool 50 (or 100 or 200) into cracks, under furniture, behind appliances, etc., so as to be able to readily and quickly reach these standard hard-to-reach regions and suck debris (solid and/or liquid) through the tool 50, optional extension wand 30, and vacuum hose 20 and into the debris collection tub of the vacuum appliance 10, without losing vacuum suction/vacuum flow rate through the tool as the tool bends and twists to reach these regions.

Other and further embodiments utilizing one or more aspects of the inventions described above can be devised without departing from the spirit of Applicant's invention. For example, it is envisioned that a flexible crevice tool such as tool 100 may comprise more than one helical structure to form the flexible region 110, or may comprise a tapered helical structure which tapers to a narrower dimension as the tool progresses from the attachment end to the nozzle end. Further, the various methods and embodiments of the process of manufacturing the assemblies described herein can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An accessory tool for a vacuum appliance, the tool comprising: an extended tool body; an attachment end of the extended body for slidably mounting the tool to a hose assembly connected to the vacuum appliance; a nozzle end longitudinally spaced apart from the attachment end and having an air flow entrance; and a self-supporting, flexible region integrally formed with and intermediate between the attachment end and the nozzle end, wherein the flexible region comprises a support skeleton consisting of a semi-rigid material, the support skeleton comprising an upper support spine and a lower, opposite support spine, a plurality of support ribs extending between the upper and lower support spines and transverse to a longitudinal axis of the body, the support ribs forming rib spaces between the individual ribs; and wherein the flexible region further comprises a flexible layer extending over an outer surface of the plurality of support ribs.

2. The accessory tool of claim 1, wherein the flexible layer is an elastomer over-molded over the one or more support ribs such that the elastomer extends in between each of the one or more support ribs.

3. The accessory tool of claim 2, wherein the elastomer is selected from the group consisting of rubbers, polypropylene, polyurethane, and thermoplastic elastomers.

4. The accessory tool of claim 1, wherein the attachment end, the nozzle end, and the flexible region are integrally molded in one piece.

5. The accessory tool of claim 1, wherein the flexible region is laterally bendable about a central axis extending through the tool about a radius ranging from about 0° to about 45° without decreasing the vacuum air flow through the tool.

6. The accessory tool of claim 1, wherein the support ribs are oriented parallel to each other, and wherein the nozzle end has a taper having a plane angle ranging from about 5° to about 80° relative to the longitudinal axis of the tool body.

7. A flexible accessory tool for a vacuum appliance, the tool comprising: an extended body having a longitudinal axis extending therethrough; an attachment end located at a first end of the extended body for slidably mounting the tool to a hose assembly connected to the vacuum appliance; a nozzle end spaced longitudinally apart from the attachment end and having an air flow entrance formed therein a self-supporting, flexible region integrally formed with and intermediate between the attachment end and the nozzle end, wherein the flexible region comprises a support skeleton, the support skeleton comprising: an upper support spine; a lower support spine located opposite the upper support spine; and a plurality of support ribs extending between the upper support spine and the lower support spine and transverse to the longitudinal axis of the body of the tool, the support ribs forming rib spaces in between the individual ribs; and a non air-permeable flexible material extending over the one or more support ribs.

8. The accessory tool of claim 7, wherein the non air-permeable flexible material is an elastomeric material over-molded over the outer surface of the plurality of support ribs.

9. The accessory tool of claim 8, wherein the elastomer is selected from the group consisting of rubbers, polypropylene, polyurethane, and thermoplastic elastomers.

10. The accessory tool of claim 7, wherein the flexible region is laterally bendable about a central axis extending through the tool about a radius ranging from about 0° to about 45° without decreasing the vacuum flow rate through the tool.

11. The flexible accessory tool of claim 7, wherein the support ribs are oriented parallel to each other, and wherein the nozzle end has a taper having a plane angle ranging from about 5° to about 80° relative to the longitudinal axis of the tool body.

12. An accessory tool for a vacuum appliance, the tool consisting essentially of: a hollow, tubular body portion with a working air passageway formed therein about a central longitudinal axis, the body having an attachment end at a first end of the tubular body portion for attachment to a vacuum appliance; an elongated, tapered body region extending from a second, opposite end of the tubular body portion; a nozzle opening located at the distal end of the tapered body region for the fluid uptake of debris-containing air into the working air passageway of the tool; and, an elongated flexing region spaced intermediate between the tapered body region and the nozzle opening, wherein the elongated flexing region comprises a support skeleton consisting of a semi-rigid material, the support skeleton comprising: an upper support spine; a lower support spine located opposite the upper support spine; a plurality of support ribs extending between the upper and lower support spines and approximately perpendicular to the longitudinal axis of the body, the support ribs forming a plurality of rib spaces between the individual ribs; and further comprising an elastomeric material overmolded over an outer surface of the elongated flexing region.

13. The accessory tool of claim 12, wherein the elastomer is selected from the group consisting of rubbers, polypropylene, polyurethane, and thermoplastic elastomers.

14. The accessory tool of claim 12, wherein the tool has 360° of flexibility about the central axis extending through the tool without decreasing the vacuum flow through the tool.

15. The accessory tool of claim 12, wherein the elongated flexing region is laterally bendable about the central axis extending through the tool about a radius ranging from about 0° to about 45° without decreasing the vacuum flow through the tool.

* * * * *